US006367205B2

(12) United States Patent
Cornett, Sr.

(10) Patent No.: US 6,367,205 B2
(45) Date of Patent: Apr. 9, 2002

(54) ANCHOR FOR A STRUCTURAL TIE-DOWN APPARATUS

(75) Inventor: Robert M. Cornett, Sr., Tampa, FL (US)

(73) Assignee: Hurri-Bolt, Inc., Tampa, FL (US)

( * ) Notice: Subject to any disclaimer, the term of this patent is extended or adjusted under 35 U.S.C. 154(b) by 0 days.

(21) Appl. No.: 09/734,378

(22) Filed: Dec. 11, 2000

Related U.S. Application Data

(63) Continuation-in-part of application No. 09/166,336, filed on Oct. 5, 1998, now Pat. No. 6,161,339.

(51) Int. Cl.[7] ..... E04H 9/14; E02D 27/32

(52) U.S. Cl. ..... 52/23; 52/293.3; 52/295; 52/223.13; 52/741.3; 52/745.21

(58) Field of Search ..... 52/23, 92.2, 93.1, 52/291, 293.3, 295, 741.3, 745.21, 643, 223.13, 223.14

(56) References Cited

U.S. PATENT DOCUMENTS

| | | | | | |
|---|---|---|---|---|---|
| 4,439,077 | A | | 3/1984 | Godsted | |
| 5,384,993 | A | * | 1/1995 | Phillips | 52/293.3 X |
| 5,491,935 | A | * | 2/1996 | Coxum | 52/23 X |
| 5,531,553 | A | | 7/1996 | Bickford | |
| 5,666,774 | A | * | 9/1997 | Commins | 52/295 X |
| 5,674,035 | A | | 10/1997 | Hettich et al. | |
| 5,782,048 | A | * | 7/1998 | Ramirez | 52/295 |
| 5,890,332 | A | * | 4/1999 | Skidmore et al. | 52/271 |
| 6,151,844 | A | * | 11/2000 | Kovachevich | 52/167.1 |
| 6,161,339 | A | | 12/2000 | Cornett, Sr. et al. | |
| 6,195,949 | B1 | * | 3/2001 | Schuyler | 52/223.13 |

OTHER PUBLICATIONS

Powers Fasteners, Inc., Catalog No. 00200, "Wedge Bolt, Blue Tip", publ. 2000.

* cited by examiner

*Primary Examiner*—Laura A. Callo
(74) *Attorney, Agent, or Firm*—David Kiewit

(57) ABSTRACT

Top plate tie-down arrangements are used for securing the roof of a structure against damage caused by high winds, earthquakes, and the like by anchoring the top plate of a wall to a foundation slab. An anchor for use in a top plate tie-down arrangement has a self-tapping thread on one end that allows it to be threaded into a hole drilled into the slab. The upper end of the anchor, which protrudes through a sill plate, is threaded to engage a connecting nut that ties the anchor to an elongated vertical fastener attached to the top plate. The lengths of various portions of the anchor and of the hole into which it is threaded are selected so that the sill plate is captured between the connecting nut and the slab.

7 Claims, 3 Drawing Sheets

ANCHOR FOR A STRUCTURAL TIE-DOWN APPARATUS

CROSS REFERENCE TO RELATED APPLICATIONS

This application is a continuation-in-part of U.S. Ser. No. 09/166,336, filed Oct. 5, 1998, which issued on Dec. 19, 2000 as U.S. Pat. No. 6,161,339.

STATEMENT REGARDING FEDERALLY SPONSORED RESEARCH OR DEVELOPMENT

Not Applicable

BACKGROUND OF THE INVENTION

FIELD OF THE INVENTION

This invention relates to arrangements for securing the roof of a structure against damage caused by high winds, earthquakes, and the like.

BACKGROUND INFORMATION

It is known to reinforce a building wall to resist wind and earthquake damage by the use of what will hereinafter be called a "top plate tie down" arrangement in which vertically disposed elongate fastening members that can be loaded in tension (e.g., a threaded metal rod) connect a top plate of the protected wall to an anchor beneath the wall, where the anchor is fixedly attached to a slab or is buried in or otherwise attached to the ground. As described in a parent application now issued as U.S. Pat. No. 6,161,339, a satisfactory anchor for such apparatus may be set in position prior to pouring a concrete foundation slab. The anchor can then be used both to retain a sill plate and to connect an elongate top-plate fastener to the foundation.

The use of conventional embedded anchors can lead to problems in installing a top plate tie down system if the anchors are not embedded at the proper positions along a sill or if the anchors are not set in a fully upright position. Because it is difficult to ensure that a correctly oriented anchor is located at each position where a top plate elongate fastener is to be installed, many builders would prefer to fasten anchors to an already hardened slab.

It is known, for example, to anchor a sill plate to a slab by driving through the sill plate into the slab and then gluing (e.g., with an epoxy cement) an anchor into the hole formed in the slab. If dust from the drilling operation is not carefully removed from the hole before inserting an epoxy-enrobed anchor, this approach results in an anchor with a very low pull-out strength. Although such an anchor may be satisfactory for retaining a sill plate against lateral forces, it can not safely be used as part of a top plate tie down apparatus. Glued, or otherwise bonded, anchors are generally not acceptable for top plate tie down use because of both the high likelihood of there being at least one dust-contaminated and weakened anchor along a wall, and because of the time and expense involved in running a separate pull-out test on each anchor.

Expansion-type anchors are widely used when a high pull-out strength connection must be made to a masonry support. Because this sort of anchor induces a high lateral stress in the masonry, it can cause portions of a masonry body to spall off if the anchor is placed too near a free edge of the body. Top plate tie-down arrangements are, of course, installed on exterior walls near the edge of a foundation slab. Hence, expansion anchors can not be used.

Self-tapping threaded masonry anchors are of interest to the present invention. Notable among commercially available hardware of this sort products sold under the trade name "Wedge-Bolt" by Powers Fasteners, Inc., of New Rochelle, N.Y. Patent references in this technical area include:

- U.S. Pat. No. 5,674,035, wherein Hettich et al. teach a thread forming screw having ratios of the sizes of various portions of the screw selected to reduce screw-in torque;
- U.S. Pat. No. 5,531,553, wherein Bickford describes a masonry anchor having a dust-relief groove disposed between thread lands; and
- U.S. Pat. No. 4,439,077, wherein Godsted discloses a threaded fastener for use in hard aggregates.

BRIEF SUMMARY OF THE INVENTION

The invention provides an improved anchor for a top plate tie down arrangement comprising a plurality of elongate vertical fasteners attached between the top plate and respective anchors disposed beneath the wall. In a preferred embodiment the anchor comprises a stud having one end adapted to be threaded into a concrete foundation slab and a second end threaded to receive a coupling nut for attaching the stud to a respective elongate vertical fastener.

It is an object of the invention to provide a top plate tie down apparatus connecting a top plate of a wall to a concrete foundation. As is conventional in construction practice, the wall extends upward from a sill plate placed on the concrete foundation and having a plurality of generally vertical throughholes through it, where the throughholes can be formed either before or after placement of the sill plate on the sill. The inventive apparatus preferably comprises a selected number of anchors, where the number of anchors is generally selected to match the number of throughholes in the sill. Each of these anchors has a respective portion threadably engaging the foundation beneath the wall along an embedment length of the anchor, each anchor has a respective upper portion threaded along at least a selected penetration length that is selected to accord with the accessible threaded depth of a connecting nut, and each of the anchors has a length equal to a sum of the penetration length, the sill thickness and the embedment length. In addition, the preferred apparatus comprises the selected number of vertical tensile fasteners, where each of the vertical tensile fasteners is connected to the top plate—e.g., by means such as those shown in the parent application hereto. Each of these vertical tensile fasteners further comprises a respective lower threaded portion at a respective lower end thereof, where each of the lower threaded portions has a selected lower portion thread length that, like the thread length on the anchor, is selected to accord with a connecting nut Each of the connecting nuts has a length at least as large as the sum of the penetration length and the selected lower portion thread length and has a first end threaded onto a respective one of the anchors, and a second end threaded onto the respective lower threaded portion of a respective one of the vertical tensile fasteners.

It is an additional object of the invention to provide a method of attaching a top plate of a wall to a slab disposed beneath the wall. The preferred method begins with a step of drilling a selected number of holes into the slab, where each of the holes extends into the slab by more than an embedment length of an anchor bolt, and preferably by about one bolt diameter more than the embedment length. An anchor bolt is then inserted through a throughhole in a sill plate into each of these holes and turned so as to thread the anchor bolt into the hole. In the preferred method a connecting nut threaded onto an upper threaded portion of each anchor bolt provides a set of flat surfaces that can be gripped by a wrench and used to turn the bolt into the hole. Moreover, it is also preferred to place a washer between the connecting nut and the sill plate before turning the bolt into the hole so as to effectively capture the sill plate between the connecting nut and the slab without deforming the sill plate. It will be understood by those skilled in the art that this method can be carried out by the use of a sill plate that has pre-drilled throughholes, or by drilling through the sill plate when drilling the hole into the slab.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
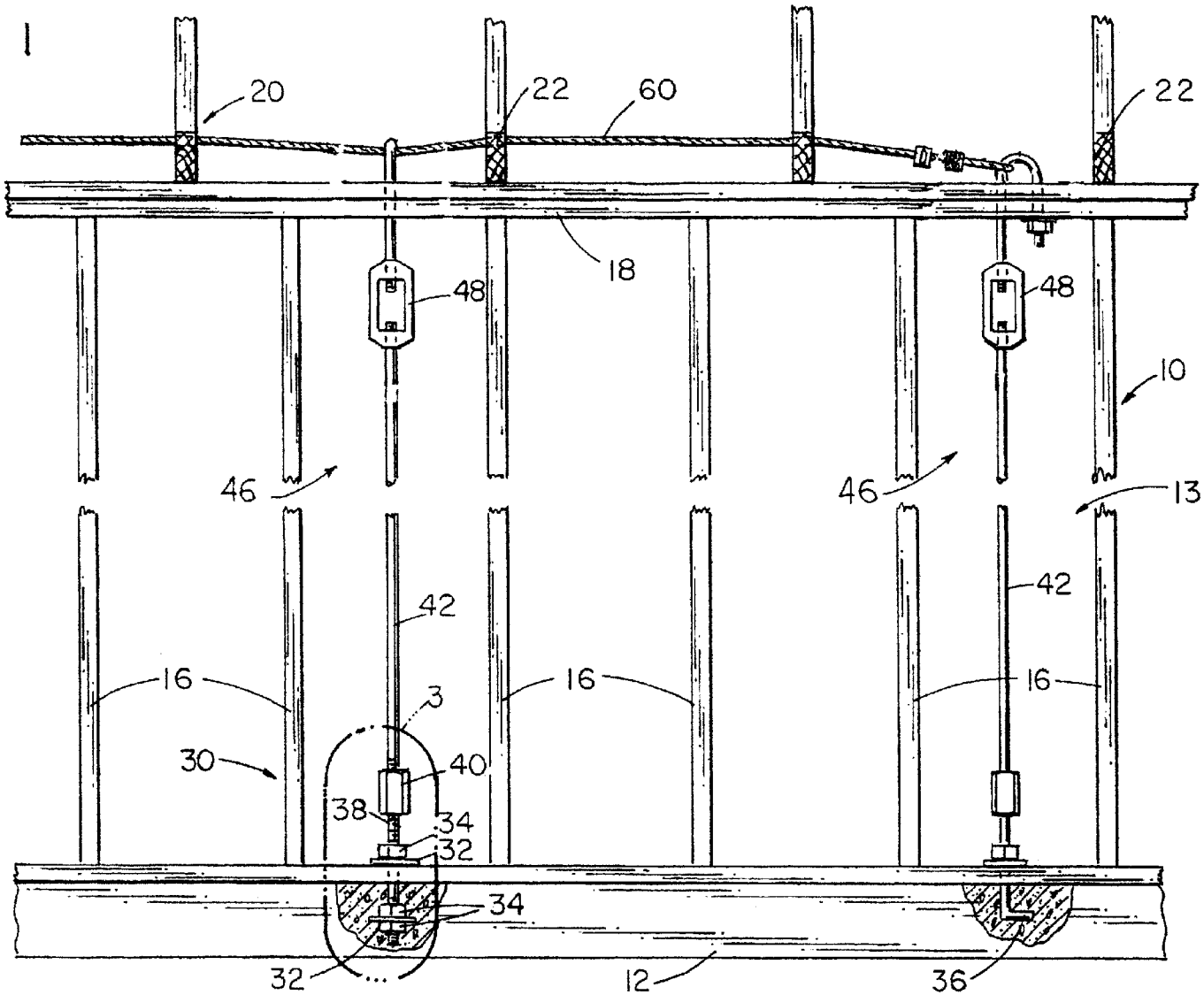
FIG. 1 is an elevational view taken perpendicular to a framed wall and showing a plurality of roof framing members transverse to the wall anchored to a foundation beneath the wall.
Figure 2:
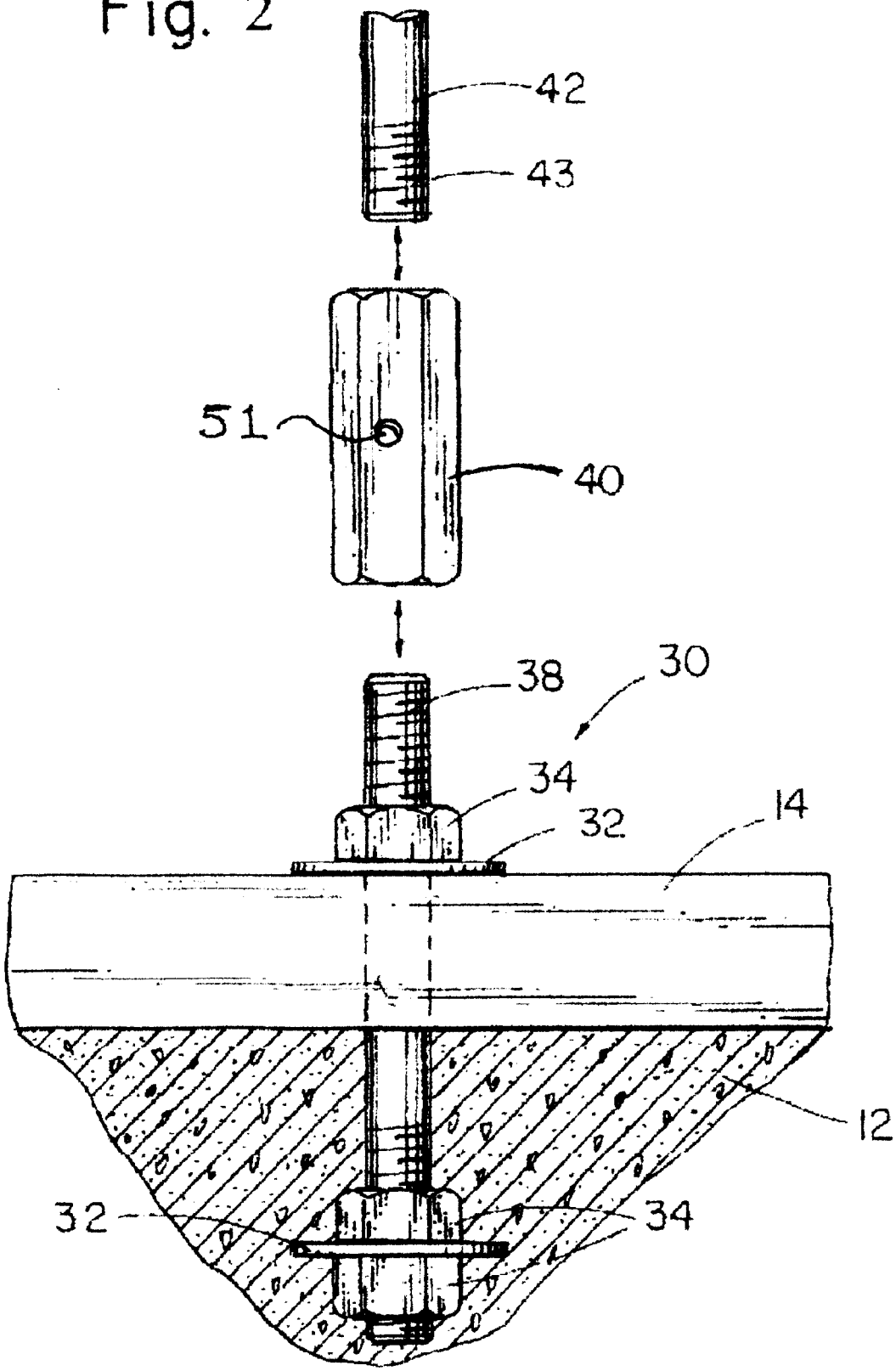
FIG. 2 is a partly cut-away elevational detail view of an anchor embedded in the foundation.

Turning now to FIG. 1, one finds a wood framed wall 10 standing on a concrete foundation slab 12 and having a tie down apparatus 13 added thereto. The wall 10 may comprise a sill 14 or foot member laid upon the foundation 12 and bolted thereto; a plurality of vertically disposed framing members 16 or studs, and a top plate 18 that is fastened across the top of the studs 16. A roof 20, conventionally supported by the wall 10, comprises a plurality of roof framing members 22 transverse to the wall 10 and above the top plate 18. Although the preferred embodiment is depicted with reference to a wooden framed wall, other sorts of wall construction may also be employed. For example, a metal framed wall, of the type commonly used in commercial building construction could be employed. So, for that matter, could a concrete block or brick wall having a top plate 18 disposed thereupon. Moreover, although the invention is herein described and depicted with respect to an exterior wall of a building, the same arrangement could clearly be applied to an interior wall crossed by one or more roof members.

It is conventional in wall construction for a foundation 12 to be made with a selected number of anchors 30 set into the slab. These anchors are spaced out along a line for the purpose of bolting the sill 14 to the foundation 12. One approach to doing this is to insert a plurality of anchors 30 into the wet concrete of the foundation 12 before the concrete has set. Another is to suspend a plurality of anchors from a horizontal board positioned at the top of the pouring frame and to then pour concrete over the suspended anchors. The bottom end of each anchor 30 is configured to extend laterally outwards (e.g., by clamping a washer 32 between two nuts 34, or by providing a elbow-like bent portion 36) so that the anchor 30 can not be pulled out of the foundation 12. The plurality of anchors 30 are spaced out along the centerline of the wall 10, and a corresponding plurality of throughholes are cut into the sill 14 so that when the sill 14 is placed upon the foundation 12 a threaded upper end 38 of a respective anchor 30 projects through each hole. A washer 32 and nut 34 are then put on each anchor 30 in order to secure the sill 14 to the foundation 12. In an embodiment of the invention disclosed in parent application 09/166,336, now issued as U.S. Pat. No. 6,161,339, similar arrangements are used, but the anchors 30 are selected to have a threaded upper end 38 projecting somewhat higher above the sill than would be the case for a conventional wall so that a connecting nut 40 can be used to connect each anchor 30 to a respective vertical rod 42 portion of the tie down apparatus 13. That is, the anchor 30 of the preferred embodiment serves both the conventional purpose of bolting the sill to the foundation, as well as serving as part of a means of tying the top plate 18 to the foundation 12.

In an embodiment described in parent application 09/166,336, now issued as U.S. Pat. No. 6,161,339, the vertical rod has a threaded region 43 on its lower end. The length of the threaded region is selected to be a bit less than half the length of a connecting nut 40. In one embodiment the connecting nut 40 is one and three quarters inches long and has an internal stop 51 formed by punching a portion of the connecting nut's wall inward so as to limit the penetration depth of a screw thread to be no more than three quarters of an inch. In this case a threaded region 43 having a length of three quarters of an inch is provided on the rod. A worker assembling this tie down apparatus 13 is instructed to initially fully thread the connecting nut 40 to the rod 42. The rod 42 is then placed vertically above the anchor 30, and the connecting nut 40 is threaded onto the upper end 38 of the anchor 30 by turning the rod 42. This assures that the same number of threads on each of the two threaded regions 38, 43 are captured by the nut so as to provide the strongest possible connection. Prior art top plate bolting arrangements employing a rod threaded along its entire length did not provide this means of assuring that the rod and anchor are joined in a maximum strength configuration. Those prior art arrangement allowed a worker to assemble a connection that is acceptable to all outward appearances, but that is seriously weak because only one thread is engaged on either the rod or the anchor.

Figure 3:
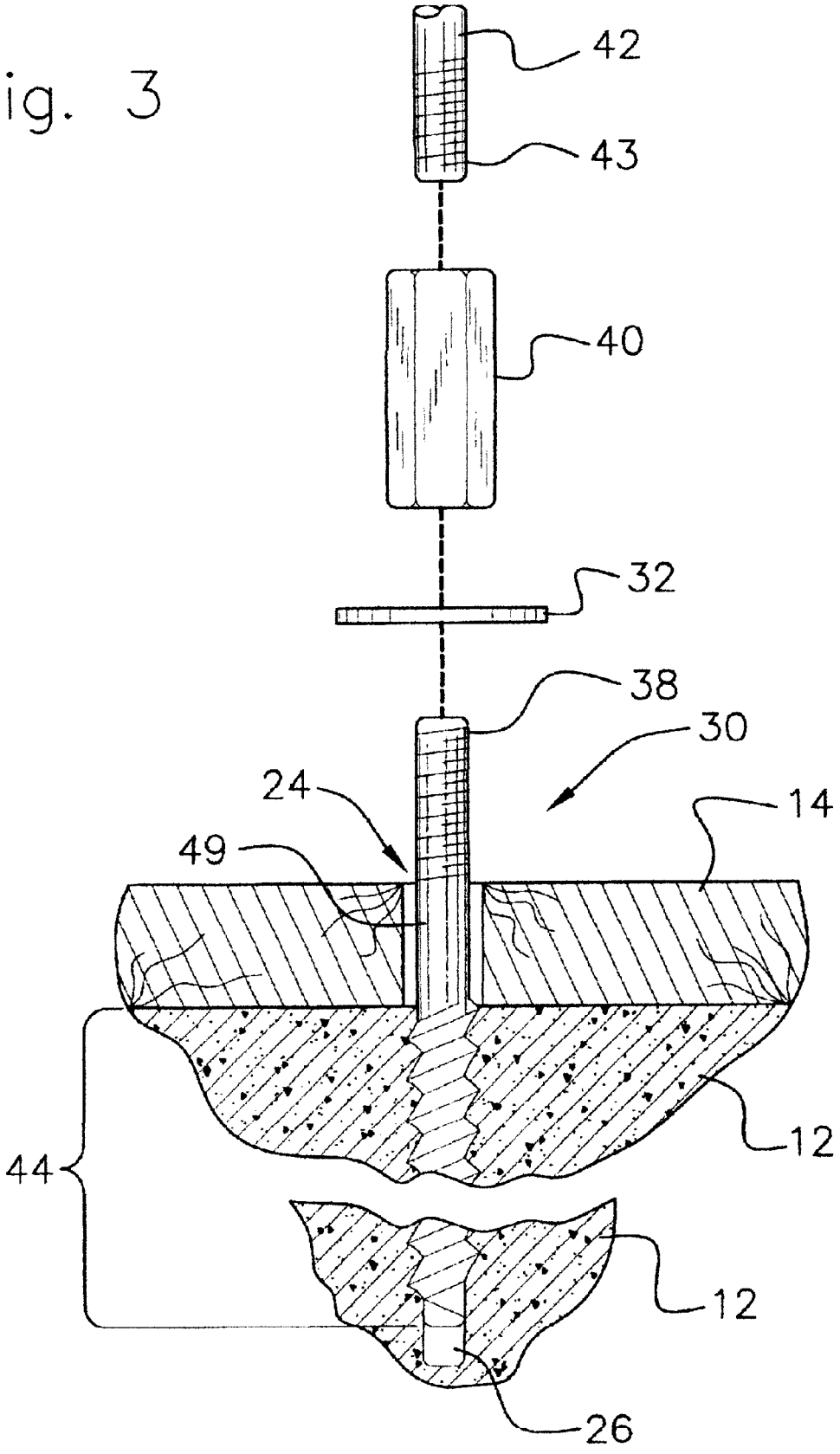
FIG. 3 is a partly cut-away elevational view of a preferred anchor.

In a preferred embodiment, as depicted in FIG. 3, a threaded anchor 24 is turned into a hole 26 drilled into a hardened foundation slab 12 so as to capture a sill plate 14 between a connecting nut 40 and the slab 12. In one particular case the threaded anchor 24 has an overall length of about nine inches. At one end of this anchor there is a embedment length portion 44 about six inches in length that has a nominal half inch self-tapping lead thread formed on it. The lead thread preferably comprises a helical land having a relatively high helix angle and a helical dust relief groove formed in the body of the anchor. At the other, upper, end there is a second threaded portion 38 adapted to engage a connecting nut 40. This portion generally has a length about one half the length of an associated connecting nut and may, for example, be about three quarters of an inch long with a $\frac{7}{16}$×12 thread. In a preferred embodiment an unthreaded intermediate portion 49 of the anchor has a length approximately the same as the thickness of lumber used for forming a sill plate 14. As depicted, the preferred arrangement accommodates a washer 32 between the connecting nut 40 and the sill plate. In the exemplar case, the intermediate portion 49 has a length of about one and three quarters inch. It will be understood by those skilled in the art that as long as enough of the upper portion of the anchor is threaded, the penetration depth of the anchor into the connecting nut is limited by an internal stop 51 in the middle of the connecting nut, and not by the threaded length of the upper portion, Hence, it is really not important whether the intermediate portion of the anchor is threaded or not. In any event, as long as the hole is deep enough, the overall length of the self threading anchor will be approximately equal to the sum of the penetration depth of the anchor into the connecting nut, the sill thickness and the embedment length.

To install the preferred self-threading anchor 24, a hole is drilled through the sill plate and into the concrete slab, preferably by using a special drill bit designed for drilling pilot holes for fasteners that have the self tapping lead thread on the anchor. The preferred hole extends into the slab to a depth of about one anchor bolt diameter (e.g., one half inch) longer than the embedment length 44 of the anchor, and is preferably cleaned (e.g., by means of one or more blast(s) of compressed air) before the anchor 24 is inserted. A connecting nut 40 having a limited thread extent (e.g., that has a detent or other center stop 51), is turned onto the end of the anchor that will be uppermost after installation, a washer 32 is placed around the anchor shaft, and the anchor 24 is turned into the hole so as to tightly capture the sill plate 14 between the washer 32 and the foundation 12.

In the top plate tie down system taught in parent application 09/166,336, now issued as U.S. Pat. 6,161,339, a cable 60 disposed above the top plate 18 is tensed by tightening a respective turnbuckle 48 on each of a plurality of rods 46. In an arrangement of this sort, if any one of the anchors disposed along a wall pulls out of the slab, the tension in the cable 60 is relaxed. Hence, it is important that each anchor be reliably tied to the slab.

It is easy to test the preferred anchoring arrangement disclosed above to ensure that each and every anchor is secure. Inspection of the anchor is a two-step process in which the inspector first checks to see that the washer 32 is not loose and then tries to apply a test torque to the connecting nut with a pre-set torque wrench. If the connecting nut does not turn responsive to the test torque, the inspector can conclude that the embedment portion of the anchor is securely engaging the slab.

From the foregoing, it can be seen that the invention provides a preferred method of securing a wall to a foundation so as to resist severe wind loads and other stresses tending to detach the roof from the wall, the method comprising the steps of:

a) inserting each of a selected number of anchor bolts into respective holes drilled into a hardened foundation slab so that each anchor bolt presents a vertically oriented threaded upper end extending above a sill. These anchor bolts are spaced out along the center line of the wall and extend through respective throughholes in the sill.

b) tightening each anchor bolt, by means of a respective connecting nut threaded onto the threaded upper end, so that the sill is captured between the connecting nut and the foundation slab;

c) threadably connecting a rod having a length less than the distance between the sill and a top plate of the wall to the upper end of each anchor bolt by means of the respective connecting nut.

d) connecting each rod to tie-down apparatus above the top plate.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. A method of attaching a top plate of a wall to a slab disposed beneath the wall, the method comprising the steps of:

a) drilling a selected number of holes into the slab, each of the holes extending into the slab by more than an embedment length of an anchor bolt;

b) inserting each of the selected number of anchor bolts through a respective throughhole in a sill plate and into a respective hole in the slab, each anchor bolt comprising a respective embedment portion having the embedment length, each anchor bolt having a respective upper threaded portion having a selected length;

c) turning each anchor bolt, by means of a connecting nut having a bottom end thereof threaded onto the respective upper threaded portion, until the sill plate is fixedly captured between the connecting nut and the slab, d) threadably connecting a lower end of each of the selected number of vertical tensile fasteners to the top end of a respective connecting nut, each of the vertical tensile fasteners comprising an attachment means adjacent an upper end thereof, each of the attachment means attaching the respective vertical tensile fastener to the top plate.

2. The method of claim 1 wherein each of the anchor bolts has an anchor bolt diameter and each hole extends into the slab by at least one anchor bolt diameter more than the embedment length.

3. The method of claim 1 wherein the sill is captured between the connecting nut and the slab by means of a washer disposed between the connecting nut and a top of the sill.

4. The method of claim 1 wherein the selected length of the upper threaded portion of each anchor bolt is equal to a penetration length of the bolt into the connecting nut and wherein each anchor bolt has a length equal to the sum of the embedment length, the penetration length and a thickness of the sill.

5. A top plate tie down apparatus connecting a top plate of a wall to a concrete foundation, the wall extending upward from a sill disposed on the concrete foundation, the sill having a plurality of throughholes therethrough, the sill having a selected sill thickness, the apparatus comprising:

a selected number of anchors, each anchor having a respective portion threadably engaging the foundation beneath the wall along an embedment length, each anchor having a respective upper portion threaded along at least a selected penetration length, each of the anchors having a length equal to a sum of the penetration length, the sill thickness and the embedment length;

the selected number of vertical tensile fasteners, each of the vertical tensile fasteners connected to the top plate, each of the vertical tensile fasteners further comprising a respective lower threaded portion at a respective lower end thereof, each of the lower threaded portions having a selected lower portion thread length;

the selected number of connecting nuts, each of the connecting nuts having a length at least as large as the sum of the penetration length and the selected lower portion thread length, each of the connecting nuts having a first end threaded onto a respective one of the anchors, each of the connecting nuts having a second end threaded onto the respective lower threaded portion of a respective one of the vertical tensile fasteners.

6. The apparatus of claim 5 wherein the penetration length is equal to the selected lower portion thread length.

7. The apparatus of claim 5 wherein the anchor threadably engages the foundation by means of a self-tapping lead thread comprising a helical land having a high helix angle, the lead thread further comprising a helical dust relief groove formed in a body of the anchor.

* * * * *